United States Patent [19]

Steiner

[11] 4,438,790

[45] Mar. 27, 1984

[54] APPARATUS FOR GUIDING A FLUID MEDIUM DRIVEN WEFT THREAD IN THE SHED OF A LOOM AND USE OF THE APPARATUS AT A MULTIPLE LONGITUDINAL TRAVERSING SHED LOOM

[75] Inventor: Alois Steiner, Rieden/SG, Switzerland

[73] Assignee: Rüti Machinery Works Ltd., Rüti, Switzerland

[21] Appl. No.: 241,934

[22] Filed: Mar. 9, 1981

[30] Foreign Application Priority Data

Mar. 27, 1980 [CH] Switzerland ..... 2440/80

[51] Int. Cl.[3] ..... D03D 47/30

[52] U.S. Cl. ..... 139/435; 139/188 R

[58] Field of Search ..... 139/188, 435, 443; 226/97

[56] References Cited

U.S. PATENT DOCUMENTS

| | | | |
|---|---|---|---|
| 3,557,845 | 1/1971 | Svaty et al. | 139/435 |
| 3,742,973 | 7/1973 | Kakae | 139/435 |
| 3,796,236 | 3/1974 | Kamp | 139/435 |
| 3,828,828 | 8/1974 | Cernocky et al. | 139/435 |

FOREIGN PATENT DOCUMENTS

| | | | |
|---|---|---|---|
| 586298 | 6/1976 | Switzerland | 139/435 |

*Primary Examiner*—Henry Jaudon

*Attorney, Agent, or Firm*—Werner W. Kleeman

[57] ABSTRACT

An apparatus for guiding a weft or filling thread in the shed of a loom, the weft thread being driven by a flowing fluid medium, comprises two lamellae combs which can dip into and out of the warp threads. The lamellae or equivalent plate-like guide elements of the lamellae combs each possess a throughpass opening for guiding the weft thread and a thread exit or outlet opening. When the lamellae are in a position completely immersed in the shed they are interleaved or shoved into one another and form a guide channel for the weft threads, this guide channel being coherent or continuous in the weft insertion direction. Hence, the thread exit or outlet openings are sealed, so that the guide channel also is continuously closed in radial direction. The closed guide channel renders possible, on the one hand, a controlled flight of the weft thread, a reduced energy consumption and driving of the weft thread both by a blowing action and also by a suction action and, on the other hand, can be particularly advantageously employed at a multiple longitudinal traversing shed loom containing a weaving rotor.

10 Claims, 6 Drawing Figures

APPARATUS FOR GUIDING A FLUID MEDIUM DRIVEN WEFT THREAD IN THE SHED OF A LOOM AND USE OF THE APPARATUS AT A MULTIPLE LONGITUDINAL TRAVERSING SHED LOOM

BACKGROUND OF THE INVENTION

The present invention relates to a new and improved construction of an apparatus for guiding a weft or filling thread in a shed of a loom, the weft thread being driven by a flowing fluid medium.

Generally speaking, the apparatus of the present development is of the type comprising two lamellae combs formed of lamellae or other equivalent guide elements and which can dip into and out of the warp threads. The platelike guide or lamellae elements of the lamellae combs each possess a throughpass opening for guiding the weft thread and a thread exit or outlet opening. In their effective or operative position, where such lamellae completely dip or immerse into the shed, such lamellae are interleaved or pushed into one another and form, by means of their throughpass openings, a coherent or continuous guide channel for the weft threads in the weft insertion direction.

With a prior art apparatus of the aforementioned type, as has been disclosed in U.S. Pat. No. 3,557,845, granted Jan. 26, 1971, the thread exit or outlet openings, the so-called thread-out or dethreading slots, at each lamellae comb are arranged at a different portion of the circumference of the throughpass openings, so that in the effective or operative position of the lamellae combs each thread-out slot of a lamella merges, in the weft insertion direction, at a solid wall portion of the immediately neighboring lamellae. In this way there should be prevented, among other things, that the weft threads, during their insertion, will be laterally blown out of the thread-out slots and remain caught at the warp threads. This objective could be partially achieved, but it was not possible to completely maintain under control the weft insertion since it was found that from time to time weft threads became caught at the lamellae combs.

SUMMARY OF THE INVENTION

Therefore, with the foregoing in mind, it is a primary object of the present invention to provide an apparatus of the type described which is not associated with the aforementioned drawbacks and limitations of the prior art constructions.

Another and more specific object of the present invention aims at improving upon this state-of-the-art apparatus so that the weft threads, during their insertion, no longer can become caught at the lamellae combs or the like.

A further important object of the present invention is to provide an improved apparatus for guiding a fluid medium driven weft thread in the shed of a loom and to the use of such apparatus at a multiple longitudinal traversing shed loom, which apparatus is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the apparatus of the present development is manifested by the features that in the aforementioned effective or operative position the thread outlet openings of the lamellae or equivalent guide elements are sealed and the guide channel also is continuously closed in radial direction.

Since the guide channel now is actually closed and no longer possesses at its walls any depressions or sinks for the flowing fluid medium, the weft thread no longer is deflected in the direction of such sinks and no longer can become caught or entrapped at the wall of the guide channel. Also since air cannot escape because of the closed wall of the channel there is realized as a further advantage a reduction in the consumption of air. Finally, with appropriate design of the inventive apparatus there is available a guide channel which is practically airtight at its wall, so that for the first time with weaving machines or looms of this type there is afforded the possibility of laying the weft threads, not merely byapplication of a blowing action, rather by a suction action. The benefits of a suction action are readily apparent to those skilled in the art and need not be further explained since it is clear that the weft thread can be considerably better controlled when there is applied a pure traction or tension force from the front of the weft thread instead of pressure at the rear thereof, and thus, such weft thread has a quieter weft insertion flight and, additionally, there can be realized an appreciable reduction in the expenditure in energy.

As already heretofore explained the invention also concerns the use of the aforementioned apparatus at a multiple longitudinal traversing shed weaving machine or loom containing a weaving rotor which is provided at its circumference with combs of shed-retaining elements for the warp threads in order to form migrating rows of open sheds.

This use of the inventive apparatus or machine is manifested by the features that there are provided at the weaving rotor for each comb of shed-retaining elements and thus for each row of open sheds two lamellae combs of the aforementioned type which can dip into and out of the sheds.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
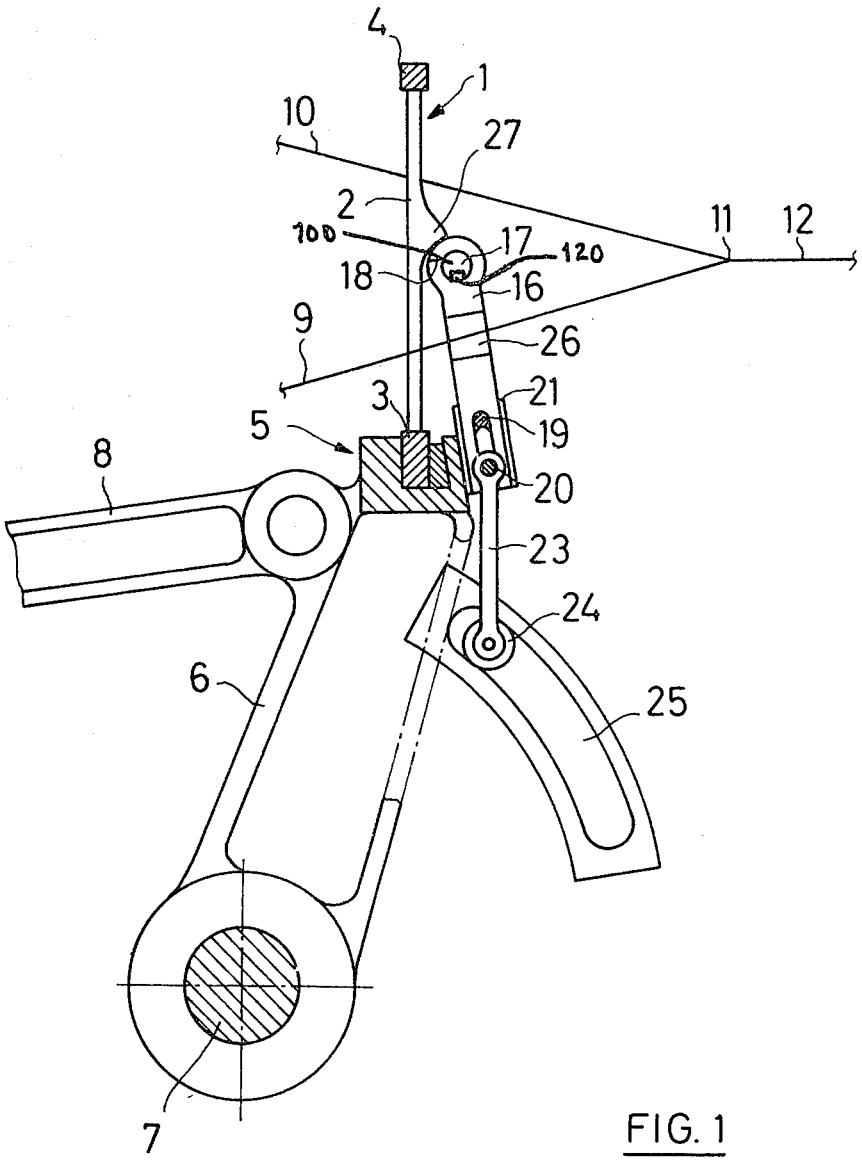
FIG. 1 is a schematic cross-sectional view through the shed of a pneumatic loom.

Describing now the drawings it is to be understood that only enough of the weaving machine or loom has been shown so as to enable those skilled in the art to readily understand the underlying principles and concepts of the present invention and to simplify the illustration of the drawings. Turning attention now to FIG. 1 there has been shown in sectional view a pneumatic loom which, as illustrated, possesses a reed 1 having reed blades or teeth 2, the ends of which are retained at a lower mounting or fixing ledge 3 and an upper mounting or fixing ledge 4 or equivalent structure. The lower mounting ledge 3 is attached in conventional manner at the sley 5 which is supported by sley arms 6. These sley arms 6 are pivotably mounted upon a sley shaft 7 arranged in the loom frame and are driven by thrust rods 8 or equivalent drive means which, in turn, are operatively connected with a not particularly illustrated drive mechanism, for instance a crank. By means of this drive mechanism or drive it is possible to periodically move the sley 5 together with the reed 1, during operation of the loom, back and forth between the position shown in FIG. 1 where the reed 1 assumes a position furthest away from the weft thread beat-up position and the actual weft thread beat-up position. Between the reed teeth or blades 2 or equivalent structure there are threaded-in, in conventional manner, warp threads 9 and 10 which experience a shed forming movement by the action of not particularly illustrated but conventional heddles of a shed-forming device. The weft or filling thread which is inserted in each case by the action of, for instance an air nozzle arranged laterally of the sheet of warp threads is beaten-up by the reed teeth 2 at the cloth fell 11 of the already produced fabric or cloth 12.

Since the air jet which drives the weft threads, as is known in this technology, rapidly diverges, it is necessary when working with pneumatic looms to provide means for the constriction or bundling and guiding of the air jet, and thus, the weft thread in the shed. Such means will now be described based upon the showing of FIGS. 1 to 3.

As illustrated, the aforementioned means are constituted by a guide arrangement composed of two guide lamellae combs 13 and 14 which consist of lamellae or plate-like elements 15 and 16, respectively, or equivalent structure. All of the lamellae or plate-like elements 15 and 16 possess a respective througpass opening 17 for guiding the weft thread and a thread outlet or exit opening 18 confronting the reed 1. The lamellae or lamellae elements 15 and 16 of each lamellae or guide comb 13 and 14, respectively, are each fixedly mounted upon a respective rod or bar member 19 and 20. The rods 19 and 20 are guided, on the one hand, in guides 21 mounted at the sley 5 and, on the other hand, are supported by drive levers 22 and 23, respectively. The drive levers 22 and 23 carry at their ends facing away from the rod members 19 and 20 a respective control roll or cam follower 24 which travels in a machine-fixed control cam 25 or equivalent structure.

Figure 3:
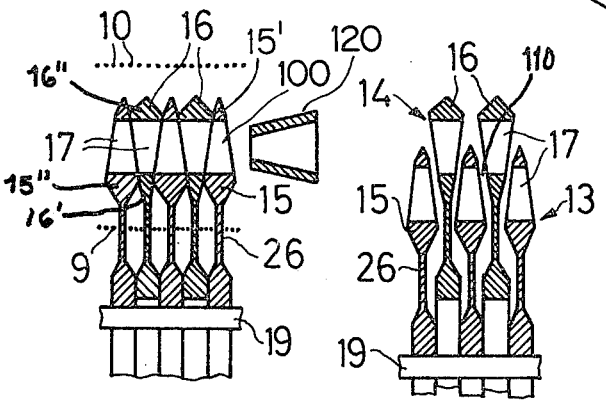
FIG. 3 a vertical sectional view through the guide channel of the loom of FIG. 1 and illustrating the same in two operating conditions.

The lamellae 15 and 16 possess in their lengthwise direction a wedge-shaped cross-sectional configuration, wherein the tip 15' of the wedge in the case of the lamellae 15 is directed upwardly and in the case of the lamellae 16 such tip 16' is directed downwardly, as best seen by referring to FIG. 3. By virtue of the drive action carried out by means of the rods or rod members 19 and 20, drive levers 22 and 23, the cam follower or control roll 24 and the control cam 25, both of the lamellae combs 13 and 14, during the pivotal movement of the sley 5, are periodically interleaved or shoved into one another and retracted away from one another, respectively. In the interleaved position illustrated at the left-hand portion of FIG. 3, corresponding to the sley position of FIG. 1, where there occurs weft insertion, the throughpass openings 17 of the lamellae 15 and 16 of both lamellae combs 13 and 14, respectively, form a guide channel, generally indicated by reference character 100, for the weft threads which is continuous or coherent in the weft insertion direction. At this point it is mentioned that the terms "lamellae combs" and "lamellae", whether used in the singular or plural, are employed in a broader sense as constituting guide arrangements in the form of guide combs formed of individual guide elements or the like coacting in the stated manner.

As best seen by referring to FIGS. 2 and 3, the lamellae 15 and 16 are provided below their respective wedge-shaped portions 15" and 16" with a respective constricted or narrower portion 26, so that sufficient space is available for the warp threads 9, in the lower shed, between the individual lamellae.

Due to the pivotal movement of the sley 5 the lamellae combs 13 and 14, during each beat-up motion, are pivoted out of the shed and during each return movement of the sley 5 are pivoted back into the shed. Hence, the warp threads 9 of the lower shed not only must arrive from the constricted or narrower portions 26 to a location over the outer edge of the lamellae, but there also must be possible a shed change of the warp threads 9 and 10. This is rendered possible in that the lamellae 15, during the beat-up phase of the reed 1, are pulled by the action of their drive downwardly relative to the lamellae 16. Hence, there is formed between the wedges or wedge surfaces 15" and 16" of the individual lamellae 15 and 16 an intermediate space 110 which is adequate for the passage of the warp threads 9 and 10. This position of the lamellae combs 13 and 14, illustrated at the right-hand portion of FIG. 3, and which is attained directly after each weft insertion, is maintained throughout the beat-up phase and during a portion of the return movement of the sley 5, until the lamellae combs 13 and 14 again completely dip into the shed and the warp threads 9 of the lower shed are located between the constricted or narrower portions 26.

As already explained, the lamellae 15 and 16 each possess a thread exit or outlet opening 18, confronting the reed 1, and serving for the departure of the weft thread out of the guide channel 100 formed by the related throughpass opening 17. The thread outlet openings 18 have the shape of a slot and the weft thread, by virtue of the pivotal movement of the sley 5 and the lamellae combs 13 and 14, automatically moves through such slot out of the lamellae 15 and 16. The lamellae 15 and 16 are elastically structured at their upper portion, in other words at the region of the openings 17, which can be conveniently accomplished through the selection of a suitable material, for instance a plastics material such as polyacetal. Due to this elastic construction of at least the upper leg 95 (FIG. 2) of the lamellae 15 and 16 it is possible to close the thread exit opening 18 during the weft insertion, and thus, to seal the guide channel 100 also in radial direction.

For this purpose the reed teeth or wires 2 or the like are provided with a nose-like projection 27 (FIG. 1) serving as a stop or impact means for the lamellae 15 and 16. These lamellae or lamellae elements 15 and 16, during the return movement of the sley 5 with interleaving of both of the lamellae combs 13 and 14, are pressed against the projections or nose-like protuberances 27, so that the thread exit or outlet openings 18 are closed. Directly after completion of the weft insertion both of the lamellae combs 13 and 14 are load relieved to such an extent that the thread exit openings 18 can open to permit throughpassage of the weft thread.

Consequently, the wedge-shaped downwardly extending lamellae 16 only perform the stroke or displacement movements needed for closing and opening the thread exit openings 18, whereas the wedge-shaped upwardly extending lamellae 15, in addition to such displacement movement, also accomplish a relative movement with respect to the lamellae 16 as is apparent from the showing of FIG. 3. In FIG. 2 there have been illustrated two lamellae 15 and 16 in a position corresponding to the condition analogous to that prevailing at the right-hand portion of FIG. 3. The arrangement of the nose-like protruberances or projections 27 at the reed teeth or wires 2 is of course chosen such that the projections 27, during the beat-up movement of the reed 1, completely depart out of the shed and the beat-up of the weft thread is accomplished by the linear portion of the reed teeth 2 above the projections 27.

The described apparatus containing the closed guide channel 100 has the appreciable advantage that the drive of the weft thread not only can be accomplished by a blowing action but also by exerting a suction action. In this case there is provided at the weft thread-exit side of the lamellae combs 13 and 14 a suction nozzle or the like, as generally indicated schematically in FIGS. 1 and 2 by rererence character 120, which is in alignment with the guide channel 100, this suction nozzle 120, if desired, can be arranged to be moveable in the weft insertion direction and during each weft insertion can be pressed against the outer lamella or guide element of the interleaved lamellae combs 13 and 14. If the upper legs 95 of the lamellae 15 and 16 are sufficiently elastic and easily bendable and the thread exit or outlet openings 18 are sufficiently narrow, then it can even be possible to close the openings 18 by the negative pressure prevailing in the guide channel and caused by the suction action, so that the use of the nose-like projections 27 (FIG. 1) can be dispensed with.

Since the warp threads, during the dipping-in and the dipping-out of the lamellae combs and during the shed change slide along the end surfaces of the lamellae 15 and 16 there is ensured that no dust or other contaminants can deposit at such locations. It also would be possible to use lamellae having parallel instead of wedge-shaped converging end surfaces. In that case, however, both of the lamellae combs must always be completely pivoted away from one another in order to render possible the passage of the warp threads between the individual lamellae. Additionally, in this case it would be advantageous, through the application of external pressure in the weft insertion direction and in the counter direction, to press the lamellae laterally against one another. This pressure could be produced, for instance, at one side of the shed by the weft laying or insertion nozzle, in other words the blow or suction nozzle, and at the other side by the use of a fixed stop.

It is also not absolutely necessary that the stop for closing the thread outlet or exit openings 18 be constituted by the nose-like projections 27 at the reed 1. Such stop or impact means could likewise be structured in a lamellae comb-like fashion and could be pivoted from above into the shed. In this case the opening of the thread outlet openings 18, following the weft insertion, could be accomplished by a movement of the stop or impact comb and as to both of the lamellae combs 13 and 14 it is only necessary for the lamellae comb 13 containing the wedge-shaped upwardly converging lamellae 15 to be elevationally displaceable, whereas the lamellae comb 14 could be fixedly mounted at the sley 5 and would not need any drive.

Figure 2:
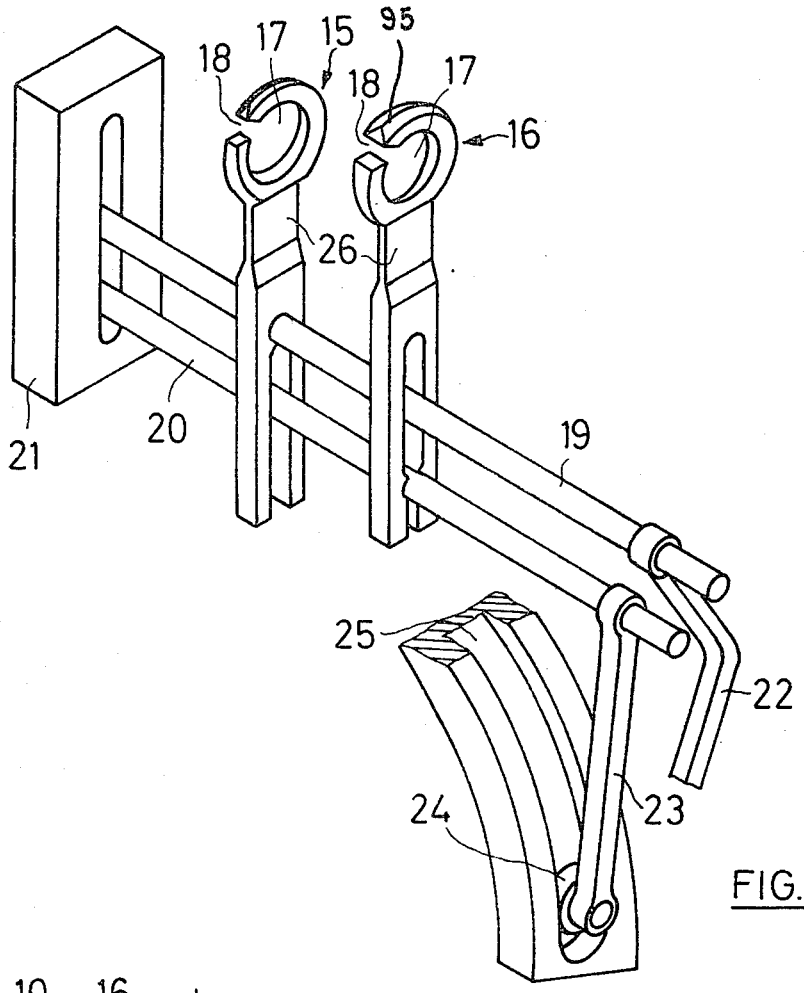
FIG. 2 is a detail of the arrangement of FIG. 1 in schematic perspective view.

In FIGS. 1 to 3 there has been illustrated the closed guide channel 100 for the weft threads in conjunction with an air nozzle loom of known design. These looms or weaving machines are so-called single-phase looms, which means that after the formation of a shed extending over the entire loom width there is inserted in each case a weft thread and such is subsequently beaten before the next shed formation is accomplished. Apart from the single-phase looms there are also known multiphase looms wherein always a plurality of mutually stepwise shifted weft threads are inserted or layed in likewise stepwise shifted and migrating sheds. If the sheds are in each case individually formed over the width of the loom and if the successively formed sheds simultaneously migrate a number of times in the direction of the warp threads, then such type of looms are referred to in the art as multiple longitudinal traversing shed looms. They have also been referred to as warp-wave looms. The inventive closed guide channel is also suitable for such type looms; in FIGS. 4 and 5 there has been illustrated the use of the guide channel at a multiple longitudinal traversing shed loom.

Figure 4:
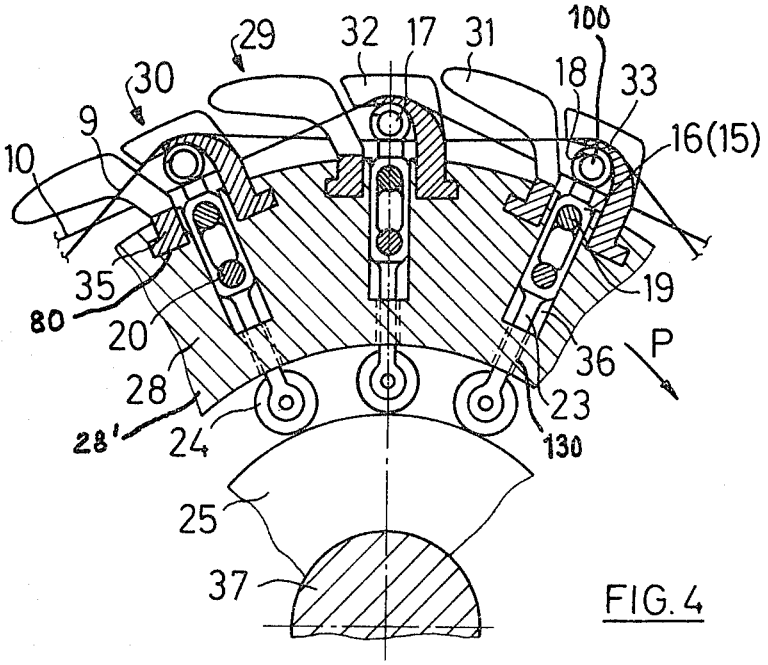
FIG. 4 is a cross-sectional view through a weaving rotor of a multiple longitudinal traversing shed loom according to a first exemplary embodiment of thread guide channels.
Figure 5:
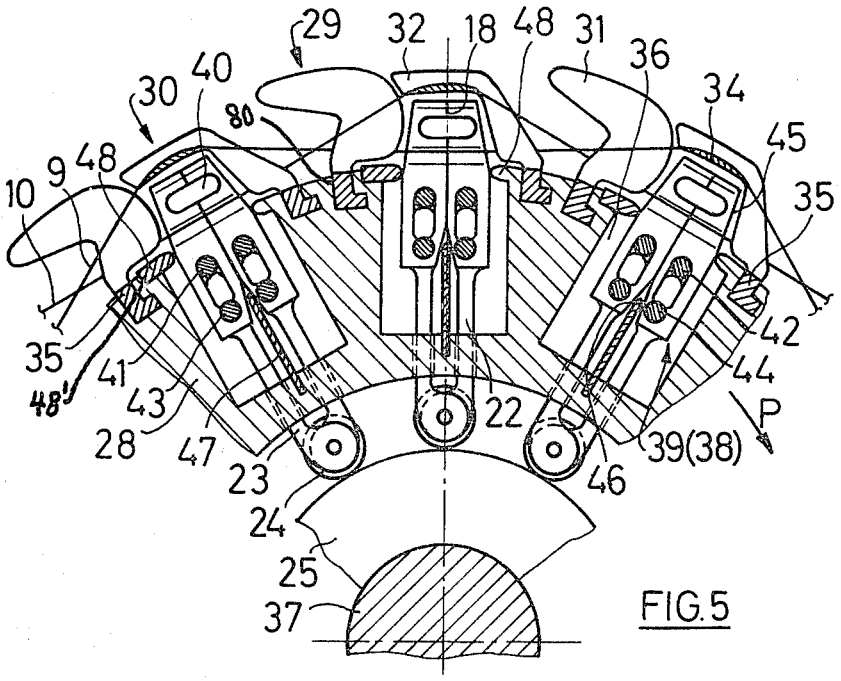
FIG. 5 is a cross-sectional view through the weaving rotor of a multiple longitudinal traversing shed loom containing a second embodiment of thread guide channels.

FIGS. 4 and 5 respectively show fragmentary cross-sectional views through the weaving rotor 28 of a multiple longitudinal traversing shed loom which, during operation, rotates in the direction indicated by the arrow P. The function and construction of such multiple longitudinal traversing shed weaving loom containing a weaving rotor is here assumed to be known and therefore the details thereof need not be further considered; in this regard reference may be made to U.S. Pat. No. 2,742,058, granted Apr. 17, 1956, exemplifying one possible construction of such type warp-wave loom and equally to the commonly assigned, copending U.S. Appli. Ser. Nos. 096,776 and 096,777, each filed Nov. 23, 1979 now respectively U.S. Pat. No. 4,290,458, granted Sept. 22, 1981 and U.S. Pat. No. 4,291,729, granted Sept. 29, 1981, to which reference may be readily had and the disclosure of which is incorporated herein by reference.

The weaving rotor 28 is constituted by a hollow roll 28' extending over the width of the loom and which is supported laterally adjacent the warp threads at the machine frame and is appropriately driven by any suitable drive means arranged likewise laterally at the machine frame. At the circumference of the weaving rotor 28 there are alternately arranged beat-up combs 29 and guide combs 30 in the lengthwise direction of the weaving rotor 28, and thus, these combs extend in the weft insertion direction. At the entire circumference of the weaving rotor 28 there are provided, for instance, in each case a total of twelve to fourteen such combs.

The beat-up combs 29 comprise beat-up lamellae or elements 31 arranged at a substantially uniform spacing from one another and serve for beating-up the inserted or layed weft threads. The guide combs 30 consist of guide lamellae or elements 32, between which there are alternately arranged the shed-retaining elements which determine the upper shed position or the lower shed position of the warp threads 9 and 10. The shed-retaining elements for the upper shed position are here, for instance, constituted by lamellae-like elements 33 (FIG. 4) or by projections 34 located at one side of the related guide lamella 32 (FIG. 5). Since the warp threads 9 and 10 bear upon the shed-retaining elements 33 and 34, as the case may be, for the upper shed position and are tensioned, there need not be provided any special shed-retaining elements for the lower shed position, rather it is sufficient if there is instead provided in each case an intermediate space up to the outer surface or shell of the weaving rotor 28. Between the lamellae 31 and 32 of the beat-up combs 29 and the guide combs 30 there are provided suitable spacer or distance elements 35.

By the action of the shed-retaining elements 33 and 34 the warp threads 9 and 10 are retained in their upper or lower shed position over the entire wrap angle between the warp threads 9 and 10 and the weaving rotor 28. The thus formed sheds migrate in tandem towards the cloth fell, and during such time when the sheds are open there are inserted in step-like offset fashion with regard to one another into each shed a weft or filling thread as is well known in the warp-wave loom technology.

The part of the beat-up lamellae 31 protruding from the weaving rotor 28, the guide lamellae 32 and possibly the shed-retaining elements 33 approximately have the shape of a finger which is curved opposite to the direction of rotation P of the weaving robot 28. The inner edge of the guide lamellae 32, the shed-retaining elements 33 or 34 and the forward outer edge of the beat-up lamellae 31, viewed with respect to the direction of rotation P, bound a channel for the weft insertion.

If the weft threads should be inserted with the aid of a flowing or fluent fluid medium, then this can be accomplished particularly advantageously when using the closed guide channel 100 illustrated in FIGS. 1 to 3, and wherein FIGS. 4 and 5 show respective embodiments by way of example.

With both of these exemplary embodiments the weaving rotor 28 is provided at its outer surface with substantially L-shaped grooves 80 in which there are supported the beat-up and guide combs 29 and 30, respectively. Between the grooves 80 and each comb pair the weaving rotor 28 is provided below the channel serving for the weft insertion and bounded by the beat-up lamellae 31 and and guide lamellae 32 with a slot 36 which extends over the entire width of the loom. In the slots 36 there are mounted to be, elevationally or displaceably adjustable the guide lamellae combs forming the closed guide channel.

With the embodiment illustrated in FIG. 4 there are used the guide lamellae combs containing the lamellae 15 and 16, as illustrated in FIGS. 1 to 3. These lamellae or lamellae elements 15 and 16 each possess a throughpass opening 17 and a thread exit opening 18 which can be closed from above by pressure. The lamellae 15 and 16 are again strung onto the rods 19 and 20, respectively, these rods being moved by drive lever means 23 and control rolls or cam followers 24 mounted thereat with the aid of a machine-fixed control cam 25, in the radial direction of the weaving rotor 28. Due to the radial movement of the rods 19 and 20 and the lamellae 15 and 16 these lamellae 15 and 16 are moved into and out of the sheds.

The control cams 25 are mounted in spaced relationship at a fixed bearing or support shaft 37. To enable passage of the drive levers or drive lever means 23 from the slots 36 to the control cams 25 internally of the rotor 28 there are provided at the base of the slots 36 appropriate cutouts or passages 130 or the like. Instead of using special drive levers 23 for the rods 19 and 20, it would also be possible for the relevant lamellae 15 and 16 to be extended downwardly at the location of the control cams 25 up to the region of the control rolls or followers 24. The lamellae 15 and 16 are attached at their rods or rod members 19 and 20 in suitable fashion, for instance by the use of an adhesive bond or welding.

The beat-up lamellae 31 and guide lamellae 32, forming the beat-up and guide combs 29 and 30, respectively, correspond in their thickness approximately to a conventional reed tooth or wire. The intermediate spaces for the lower shed position of the warp threads are likewise approximately as thick as a reed tooth or wire. The shed-retaining elements 33 for the upper shed position of the warp threads possess, on the other hand, a multiple of this thickness. During a fabric weave or article change the beat-up combs 29 and guide combs 30 are usually exchanged.

The lamellae 15 and 16 of the lamellae combs 13 and 14 forming the closed thread guide channel 100 possess, on the other hand, at their thickest location a thickness amounting to a number of millimeters, for instance 2 to 4 millimeters and in the presence of an article or fabric weave change need not be exchanged. As the stop or impact means for closing the thread exit or outlet openings 18 of the lamellae 15 and 16 there are used the shed-retaining elements 33 for the upper shed position. By virtue of the large thickness of the lamellae 15 and 16 in comparison with the pitch or distribution of the guide combs 30, there is beneficially ensured that each lamella 15 and 16 will be allocated to a suitable shed-retaining element 33 for closing the thread exit or outlet openings 18.

With the exemplary embodiment illustrated in FIG. 5 there is used for the fabrication of the closed thread guide channel 100 a different, particularly advantageous type of lamellae 38 and 39. These lamellae or lamellae elements 38 and 39, of which in FIG. 6 there have been respectively shown two in the open and in the closed channel position, each consist of two lamellae segments or segments or halves $38_1$, $38_2$ and $39_1$, $39_2$. The lamellae halves $38_1$ and $38_2$ extend convergingly upwardly in a wedge-shaped fashion at their upper portion forming the thread guide channel, and the lamellae segments or halves $39_1$ and $39_2$ extend convergingly downwardly towards one another in a wedge-shaped fashion. The wedge-shaped portions terminate at the top in a tip, so that there is facilitated the dipping or insertion into the warp threads 9 and 10. Towards the lower end there merges with the wedge-shaped portion, just as with the case for the lamellae 15 and 16 of FIGS. 1 to 4, a constricted or narrower part or portion 26 and there extends downwardly therefrom the base body of the related lamella. Both halves or segments of each lamella 38 or 39 are arranged in each case in mirror-image fashion and each possess a throughpass opening 40 open at one side, wherein the lamellae segments or halves $38_1$ and $38_2$ and $39_1$ and $39_2$, respectively confront one another at the open sides of the throughpass openings 40.

Due to the division of each lamella 38 and 39 into two lamellae segments or halves $38_1$, $38_2$ and $39_1$, $39_2$, and due to the illustrated construction of the throughpass openings or passageways 40 and the mirror-image arrangement of the lamellae halves, the lamellae 38 and 39 need not be elastically structured at their part surrounding the throughpass opening 40 and there is dispensed with the stop or impact means for sealing the related thread outlet opening 18.

Here also the closing and opening of the thread guide channel 100 is accomplished by a displacement at elevational movement of the lamellae 38 and 39, wherein here, owing to the division of each lamella into two halves, there are provided a total of four lamella combs and accordingly four drive rods 41 to 44. These drive rods 41 to 44, just as with the embodiment of FIGS. 1 to 4, are moved by drive levers 22, 23, a control roll or cam follower 24 and a machine-fixed control curve or cam 25 or the like.

Figure 6:
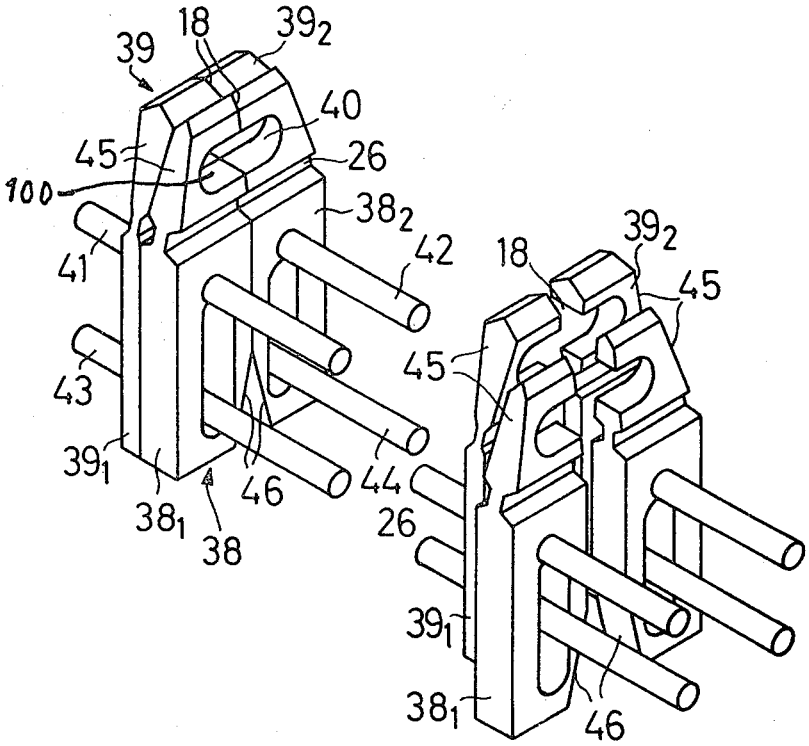
FIG. 6 is a detail of the arrangement of FIG. 5 in schematic perspective view.

During the displacement movement of the individual lamellae combs it is to be observed that both lamellae halves $38_1$, $38_2$ and $39_1$, $39_2$ of each lamella 38 and 39, respectively, perform the same displacement or stroke movement, as will be readily evident from FIGS. 5 and 6 by the drive levers 22 and 23 which in each case carry a common cam follower 24. This means that opening of the thread guide channel is not accomplished by lowering the one lamellae half or portion in relation to the other lamellae half or portion. Quite to the contrary, this opening action is accomplished by pivoting away from one another the relevant lamellae halves. For this purpose each lamellae half $38_1$, $38_2$; $39_1$, $39_2$ is provided at the outer edge of its portion which dips into the shed with a conical upwardly extending first guide flank 45 and at its lamellae body, at the contact surfaces of the lamellae bodies of both lamellae halves, with a likewise conical second guide flank 46.

At the base of each slot 36 there are adhesively bonded or otherwise appropriately fixed small plates or plate members 47 in spaced relationship from one another. These plates 47 extend from the base of the slot 36 upwardly into the free intermediate space between the second guide flanks 46. As soon as the lamellae 38, 39 are moved out of the shed towards the interior of the weaving roto 28, the small plates 47 move between the lamellae bodies of the individual lamellae segments or halves, so that such are spread apart. This spreading action is limited by the first guide flank 45 in that there is arranged a respective bead or nose 48 or eqiuvalent structure at the upper end of the side wall of the slot 36, along which there can slide the related first guide flank 45 during such time as the lamellae move out of the shed.

In order to be able to accomplish adjustment of the width of the thread exit or outlet opening 18 which is formed during spreading apart of the lamellae segments or halves as well as for accomplishing a fine regulation, it is particularly advantageous if one of both beads or noses 48 of each slot or gap 36 is constructed to be adjustable in a direction perpendicular to the lamellae side edge. In FIG. 5 such is the left bead 48 which is formed by an adjustable rail 48'. This rail 48' can be attached, for instance threadably screwed, at the weaving rotor 28.

As will be best recognized by referring to FIG. 6, the individual lamellae 38 and 39 carry out displacement movements of different magnitude. The wedge-shaped downwardly converging lamellae 39 are only lowered to such an extent that there is formed a sufficiently wide thread exit or outlet opening 18. The wedge-shaped upwardly converging lamellae 38 are lowered to a greater extent in relation to the lamellae 39, so that there is formed between the end surfaces of the indiviudal lamellae an intermediate space which renders possible the free throughpassage of the warp threads. The lamellae 38 therefore need not be moved completely to a location below the shell or outer surface of the weaving rotor 28, because the actual departure of both lamellae types 38 and 39 out of the warp threads 9 and 10 is accomplished by the rotational movement of the weaving rotor 28 and specifically, in the phase prior to beating-up of the relevant weft or filling thread. During this phase also the shed-retaining elements 33, 34 move below the beat-up plane.

During the displacement movement of the lamellae 38 and 39 or during their movement out of the warp threads 9 and 10 the weft threads can not be drawn into the slots 36, since they bear upon the warp threads of the lower shed.

Since the individual lamellae 38 and 39 perform displacement movements of different magnitudes, they and along therewith the rods 41, 42 and 43, 44, respectively, carrying the lamellae, are deflected laterally to different extents by the small plates 47 or equivalent structure. It is for this reason that the slots surrounding the rods and provided in the lamellae bodies are widened in each case towards one side, so that the rods 41, 42 or 43, 44 for the one lamellae 38 and 39, respectively, possess sufficient play for such lateral deflection within the slots of the other lamellae 39 or 38, as the case may be.

The closed guide channel illustrated in FIGS. 5 and 6 is not limited to use in a multiple longitudinal traversing shed weaving apparatus or loom, and, of course, can also be beneficially employed at single-phase pneumatic looms.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for guiding a weft thread within the shed of a loom and which is driven by a flowing fluid medium, comprising:

two lamellae combs which are capable of dipping into and out of warp threads;

each of said lamellae combs comprising elastically structured lamellae elements;

each lamella element having a throughpass opening for guiding an inserted weft thread and a thread outlet opening;

said lamellae elements when assuming an operative position where they are immersed into the shed being interleaved with one anothr and forming by means of their throughpass openings a guide channel for the weft threads inserted in a predetermined weft insertion direction;

said guide channel being essentially continuous in the weft insertion direction;

said thread outlet openings of said lamellae elements, when in their operative position, being sealed and said guide channel also being continuously closed in radial direction; and stop means operatively associated with said elastically structured lamellae elements in order to close said thread outlet openings during interleaving of both of said lamellae combs.

2. The apparatus as defined in claim 1, wherein:

said elastically structured lamellae elements are elastically structured at a portion thereof surrounding the throughpass opening of the related lamella element.

3. The apparatus as defined in claim 2, wherein:

said elastically structured portion of each lamella element comprises at least a leg which merges with the thread outlet opening of said lamella element.

4. The apparatus as defined in claim 3, further including:

suction nozzle means for supplying the flowing fluid medium for the drive of the weft thread; and said suction nozzle means being arranged at an outlet-side end of the guide channel formed by the interleaved lamellae combs.

5. An apparatus for guiding a weft thread within the shed of a loom and which is driven by a flowing fluid medium, comprising:

two lamellae combs which are capable of dipping into and out of warp threads;

each of said lamellae combs comprising lamellae elements;

each lamella element having a throughpass opening for guiding an inserted weft thread and a thread outlet opening;

said lamellae elements when assuming an operative position where they are immersed into the shed being interleaved with one another and forming by means of their throughpass openings a guide channel for the weft threads inserted in a predetermined weft insertion direction;

said guide channel being essentially continuous in the weft insertion direction;

said thread outlet openings of said lamellae elements, when in their operative position, being sealed and said guide channel also being continuously closed in radial direction;

said lamellae elements being elastically structured at a portion thereof surrounding the throughpass opening of the related lamella element;

said elastically structured portion of each lamella element comprises at least a leg which merges with the thread outlet opening of said lamella element; and stop means operatively associated with the elastic legs of said lamellae elements in order to close said thread outlet openings during interleaving of both of said lamellae combs.

6. The apparatus as defined in claim 4, wherein:

said stop means comprise substantially nose-like projections provided at reed teeth of a reed of the loom.

7. The apparatus as defined in claim 5, wherein:

said lamellae elements have end surfaces of substantially wedge-shaped configuration in a predetermined direction of displacement of said lamellae combs; and the wedge-shaped end surfaces defining wedge means at one of the lamellae combs which converge in the displacement direction of such lamellae comb and at the other lamellae comb wedge means which converge opposite to said displacement direction.

8. The apparatus as defined in claim 7, wherein:

said lamellae elements are provided with a constricted portion following their wedge means; and said constricted portion being spaced from the throughpass opening of the related lamella element such that in said operative position the warp threads cross the lamellae elements at the region of said constricted portions.

9. The apparatus as defined in claim 8, further including:

at least one rod means extending over the width of the loom;

said lamellae elements of each lamellae comb being fixed at said at least one rod means;

cam operated-drive lever means engaging with said rod means; and cam means for controlling said drive lever means.

10. The apparatus as defined in claim 9, wherein:

said loom includes a sley;

guide means mounted at said sley; and said rod means being guided at said guide means.

* * * * *

UNITED STATES PATENT AND TRADEMARK OFFICE

CERTIFICATE OF CORRECTION

PATENT NO. : 4,438,790

DATED : March 27, 1984

INVENTOR(S) : ALOIS STEINER

It is certified that error appears in the above-identified patent and that said Letters Patent are hereby corrected as shown below:

Column 12, line 9, (Claim 6,line 1) delete "4" and replace by --5--

Signed and Sealed this

*Twenty-eighth* Day of *August 1984*

[SEAL]

*Attest:*

GERALD J. MOSSINGHOFF

*Attesting Officer*

*Commissioner of Patents and Trademarks*